US008464366B2

(12) United States Patent
Carron

(10) Patent No.: US 8,464,366 B2
(45) Date of Patent: Jun. 18, 2013

(54) PROTECTIVE SUIT FOR AN INDIVIDUAL AND RELATED ASSEMBLY

(75) Inventor: Gérard Carron, Saint Alban de Roche (FR)

(73) Assignee: Materiels Industriels de Securite (FR)

( * ) Notice: Subject to any disclaimer, the term of this patent is extended or adjusted under 35 U.S.C. 154(b) by 58 days.

(21) Appl. No.: 13/148,061

(22) PCT Filed: Feb. 5, 2010

(86) PCT No.: PCT/FR2010/050188

§ 371 (c)(1), (2), (4) Date: Oct. 26, 2011

(87) PCT Pub. No.: WO2010/089514

PCT Pub. Date: Aug. 12, 2010

(65) Prior Publication Data

US 2012/0036622 A1 Feb. 16, 2012

(30) Foreign Application Priority Data

Feb. 5, 2009 (FR) ..... 09 50727

(51) Int. Cl.

| | |
|---|---|
| ***A41D 13/002*** | (2006.01) |
| ***A41D 27/28*** | (2006.01) |
| ***A62B 18/10*** | (2006.01) |
| *A62B 18/00* | (2006.01) |
| *A62B 7/00* | (2006.01) |

(52) U.S. Cl.

USPC .. 2/455; 2/272; 2/905; 2/DIG. 1; 128/201.28; 128/201.29

(58) Field of Classification Search

None

See application file for complete search history.

(56) References Cited

U.S. PATENT DOCUMENTS

| | | | | | |
|---|---|---|---|---|---|
| 2,814,290 | A | * | 11/1957 | Holmes | 128/202.11 |
| 3,190,287 | A | * | 6/1965 | Miller, Jr. | 128/202.11 |
| 3,628,531 | A | * | 12/1971 | Harris | 128/202.11 |
| 3,667,459 | A | * | 6/1972 | Durney | 128/201.15 |
| 4,328,798 | A | * | 5/1982 | Isaacson | 128/202.27 |
| 4,619,255 | A | * | 10/1986 | Spinosa et al. | 128/202.27 |
| 4,841,953 | A | * | 6/1989 | Dodrill | 128/202.27 |
| 4,847,914 | A | * | 7/1989 | Suda | 2/457 |
| 4,881,539 | A | * | 11/1989 | Pasternack | 128/201.27 |
| 5,027,807 | A | * | 7/1991 | Wise et al. | 128/201.28 |

(Continued)

FOREIGN PATENT DOCUMENTS

| | | |
|---|---|---|
| FR | 2793147 A1 | 11/2000 |
| GB | 2327358 A | 1/1999 |

OTHER PUBLICATIONS

International Search Report issued May 20, 2010 by European Patent Office re: PCT/FR2010/050188; citing: US 5,293,864 A and GB 2 327 58 A.

*Primary Examiner* — Bobby Muromoto, Jr.

(74) *Attorney, Agent, or Firm* — Cantor Colburn LLP

(57) ABSTRACT

A personal protective suit including a sealed shell equipped with connection device intended to be connected to one same pressurized air source, air distribution device having an air intake connected to the connection device, and at least one first and one second air outlet, respectively intended to supply device for delivering air to the wearer and device for ventilating the suit, wherein the air distribution device includes a valve designed to reduce the air flow rate of the second air outlet when the air pressure at the air intake is below a determined value, while maintaining the supply of air to the wearer.

12 Claims, 6 Drawing Sheets

U.S. PATENT DOCUMENTS

| | | | | |
|---|---|---|---|---|
| 5,293,864 | A * | 3/1994 | McFadden | 128/201.29 |
| D354,348 | S * | 1/1995 | Hamilton | D24/110.3 |
| 6,006,748 | A * | 12/1999 | Hollis | 128/205.24 |
| D421,298 | S * | 2/2000 | Kenyon et al. | D24/110 |
| 6,119,723 | A * | 9/2000 | Kenyon | 137/527 |
| 6,152,129 | A * | 11/2000 | Berthon-Jones | 128/200.24 |
| 6,227,199 | B1 * | 5/2001 | Garofalo | 128/204.26 |
| 6,237,592 | B1 * | 5/2001 | Surjadi et al. | 128/204.21 |
| 6,240,921 | B1 * | 6/2001 | Brydon et al. | 128/205.23 |
| 6,253,764 | B1 * | 7/2001 | Calluaud | 128/204.18 |
| 6,279,569 | B1 * | 8/2001 | Berthon-Jones | 128/200.24 |
| 6,394,088 | B1 * | 5/2002 | Frye et al. | 128/204.26 |
| 6,397,841 | B1 * | 6/2002 | Kenyon et al. | 128/202.27 |
| 6,526,974 | B1 * | 3/2003 | Brydon et al. | 128/205.24 |
| 6,532,957 | B2 * | 3/2003 | Berthon-Jones | 128/204.21 |
| 6,837,239 | B2 * | 1/2005 | Beizndtsson et al. | 128/201.25 |
| 6,837,243 | B1 * | 1/2005 | Fetters | 128/204.26 |
| 7,137,389 | B2 * | 11/2006 | Berthon-Jones | 128/204.18 |
| 7,159,533 | B1 * | 1/2007 | Redd et al. | 116/274 |
| 7,302,950 | B2 * | 12/2007 | Berthon-Jones et al. | 128/204.23 |
| 7,621,267 | B1 * | 11/2009 | Adams | 128/201.27 |
| 7,644,713 | B2 * | 1/2010 | Berthon-Jones | 128/204.21 |
| 7,694,353 | B2 * | 4/2010 | Weston | 2/171.3 |
| 7,730,847 | B1 * | 6/2010 | Redd et al. | 116/274 |
| 7,891,357 | B2 * | 2/2011 | Carron et al. | 128/205.22 |
| 8,051,853 | B2 * | 11/2011 | Berthon-Jones | 128/204.21 |
| 2004/0226558 | A1 | 11/2004 | Kausch | |
| 2007/0113318 | A1 * | 5/2007 | Weston | 2/171.3 |
| 2008/0173307 | A1 * | 7/2008 | Carron et al. | 128/205.22 |
| 2012/0066819 | A1 * | 3/2012 | Carron | 2/456 |

* cited by examiner

PROTECTIVE SUIT FOR AN INDIVIDUAL AND RELATED ASSEMBLY

TECHNICAL FIELD

The invention concerns a personal protective suit and a corresponding protective ensemble.

BACKGROUND

Protective ensembles are used in the field of civilian safety or in industry, for example in the nuclear or chemical industry to insulate a person from a hostile outside environment.

In the nuclear industry, persons are led to ensuring the maintenance of equipment or to conducting tasks in contaminated environments, contaminated in particular by radioactive particles. Under these conditions, such persons must be encapsulated in a protective suit to avoid any contact between the skin and radioactive particles and they must not breathe in any outside contaminated air.

Having regard to the long duration and complexity of some operations carried out by such persons, it is important that the wearing of this suit should be ergonomic and comfortable. In addition, it must be possible for the donning and fitting of the suit as well as the removal thereof to be performed simply and relatively quickly.

A protective ensemble is known from document FR 2 793 147. It comprises a sealed suit fed with air to allow ventilation and therefore the lowering of the temperature inside the suit. This provides increased comfort for the wearer in particular in the event of prolonged used of the protective garment.

Also, air is fed via a flexible air intake to a mask held to the wearer's face by means of supporting straps.

Another protective ensemble is described in document US 2004/0226558. It is in the form of a suit comprising in particular a part that forms a hood and means for connection to a source of compressed air. The compressed air is guided firstly into the inner volume of the hood and secondly into the other parts of the suit to ensure the ventilation thereof.

The wearer is therefore not obliged to wear a mask since it is possible directly to breathe the air contained in the hood. The air flow rate is adjusted so that there is sufficient air renewal to avoid a substantial increase in carbon dioxide within the hood.

In addition, only one air feed can be used, which allows simplification of the use of the said protective system.

In this case however, should there be pressure be drop in the air supply network, this will give rise to risks for the wearer being ill-supplied with air. There may a sudden increase in the carbon dioxide level inside the hood volume which, within a few instants, may exceed a critical threshold placing the wearer in danger.

BRIEF SUMMARY

The invention sets out to remedy this shortcoming by proposing a suit and corresponding protective ensemble which can offset a pressure drop within the air supply network.

For this purpose, the invention concerns a personal protective suit comprising a sealed outer shell equipped with connection means intended to be connected to one same pressurized air source, means for distributing air having an air intake connected to the connection means, and at least one first and one second air outlet respectively intended to supply means for delivering breathable air to the wearer and means for ventilating the suit, characterized in that the air distribution means comprise a valve reacting to air pressure at the air intake to reduce the air flow rate of the second air outlet towards the suit when the air pressure at the air intake is below a determined value, whilst maintaining the supply of breathable air to the wearer.

The means for delivering air to the wearer are therefore given feed priority. The air derived from the supply network is therefore no longer or only little used to ventilate the suit. It is recalled that the said ventilation is solely intended to ensure wearer comfort. The vital function of supplying air to the wearer at a substantially constant flow rate is therefore preserved to the detriment of comfort.

According to one characteristic of the invention, the valve is designed such that the air flow rate in the second air outlet decreases progressively with the air pressure at the air intake.

If the pressure drop in the supply network is small, it is not necessary to stop ventilation completely. In this case, only part of the air intended to ensure ventilation is diverted to the benefit of the breathable air supply to the wearer.

Advantageously, the valve comprises a shutter which, cooperating with a return spring, is designed to shut off the second air outlet in full or in part, in relation to the air pressure at the air intake.

According to one possibility of the invention, the air distribution means comprise a body in which are arranged a first channel forming the air intake, a second channel connected to the first channel and forming the first air outlet, and a third channel forming the second air outlet and leading into the first channel at a calibrated opening, the shutter and the return spring being arranged such that the shutter is applied against the calibrated opening if there is no air pressure in the first channel, the shutter being gradually moved away from the opening when the air pressure in the first channel exceeds a predetermined value.

Advantageously, the channels connected to the air outlets for the supply of air to the wearer and for ventilation of the suit are equipped with air flow rate regulators.

The flow regulators allow a flow rate to be obtained whose value varies little in the event of variation in the supply pressure. Should there be no regulation, the air passage orifices inside the distributor would need to be calibrated differently in relation to the supply pressure. Therefore, with a distributor designed to operate with a pressure of the order of 5.5 to 6.5 bars, any use with a pressure of 9 or 10 bars would translate as a delivered air flow rate that is too high, generating overpressure within the suit which may cause bursting thereof. With flow rate regulators in the channels it is possible to use the same distributor over a wide range of supply pressures.

According to one embodiment of this distributor, each flow rate regulator comprises a piston which, housed in a channel, is subjected to the action of a spring to modify the cross-section of the air throughway in relation to pressure.

Advantageously, the air distributor is mounted outside the suit and also acts as tap.

The invention further concerns a personal protective ensemble comprising means for delivering air to the wearer, equipped with an air supply line, characterized in that it comprises a protective suit according to the invention, the air supply line being connected to the first air outlet of the distribution means.

Preferably the air supply line comprises a first and a second air intake, the first air intake being connected to the first air outlet of the distribution means in normal position of use, the second air intake of the air supply line being intended to be connected to a secondary source of compressed air.

Therefore, when removing the protective ensemble, the wearer connects the second air intake to the source of compressed air and then disconnects the first air intake from the suit. The suit can then be removed whilst continuing to supply air to the wearer.

According to one characteristic of the invention, the means for delivering air to the wearer comprise a mask or hood delimiting an inner volume fed with air.

Advantageously, the suit comprises a release valve arranged to allow release of air contained in the suit towards the outside, when this air exceeds a determined pressure.

According to one embodiment of the invention, the suit comprises a removable band which, after removal, is capable of releasing an opening intended to facilitate stepping out of the suit.

Preferably the suit is equipped with at least one ventilation duct connected to the second outlet of the distribution means, designed to direct part of the pressurized air into the inner volume of the suit.

BRIEF DESCRIPTION OF THE DRAWINGS

At all events, the invention will be well understood aided by the following description with reference to the appended schematic drawing which, as an example illustrates one embodiment of this protective device and of this corresponding ensemble.

DETAILED DESCRIPTION

Figure 1:
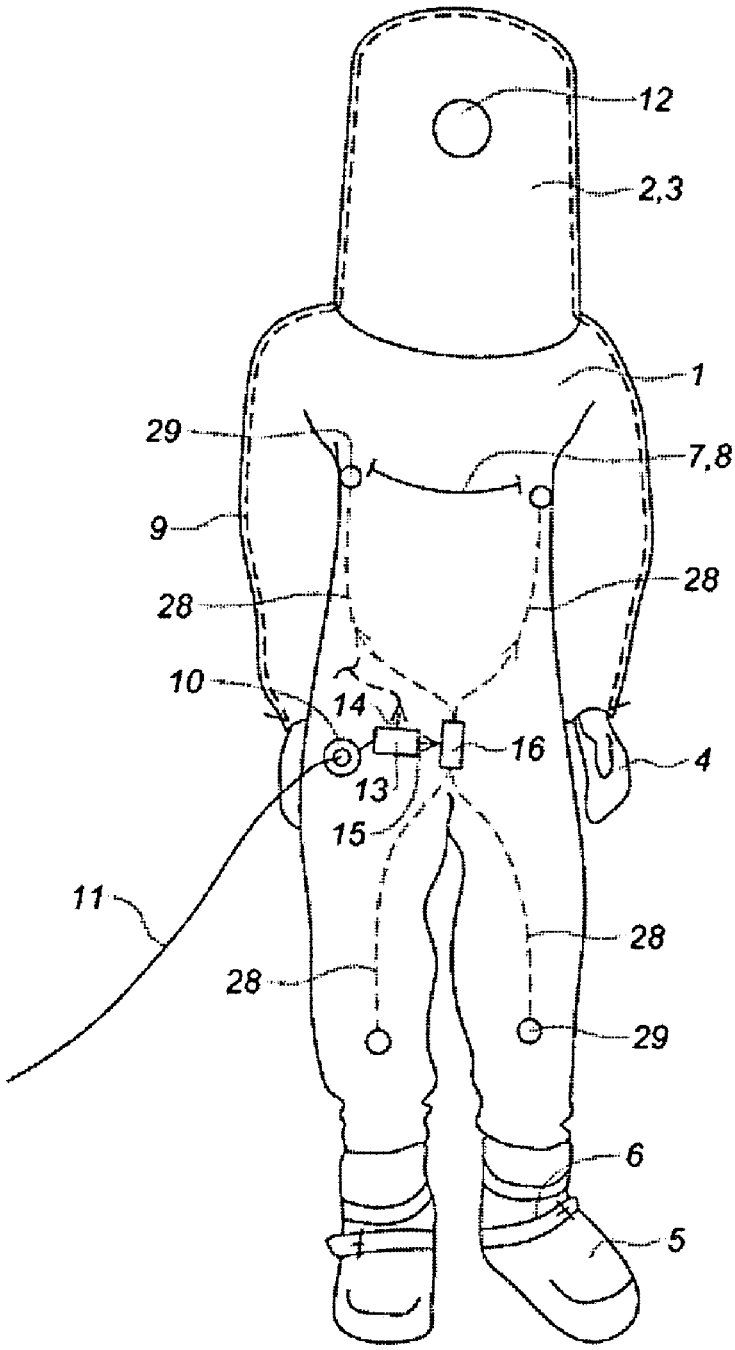
FIG. 1 is a front view of the suit.

As illustrated in FIG. 1, a protective ensemble according to the invention comprises an outer suit 1 made in a flexible, armoured material sealed against radioactive particles, for example in polyvinyl chloride on a polyester backing. The suit covers all the parts of the body and in particular it comprises a part enclosing the head, forming a helmet 2 equipped with a transparent visor 3.

The suit comprises gloves 4 and areas 5 intended to receive the wearer's feet comprising laces 6 arranged opposite the ankle and provided with quick tightening means. The suit 1 also comprises a donning opening extending over the front side of the suit, at the level of the user's chest. The opening can be closed by means of a zip fastener 7, a flap 8 being folded over the closure 7.

A removable band 9 extends from the end of one arm to the end of the other arm, the removal of the band 9 allowing full opening of the suit 1 along this area.

The front side of the suit is provided with a connector 10 extending outside the suit and intended to be connected to a compressed air supply network 11. A release valve 12 is arranged in the back part of the helmet 2 allowing the release of air contained inside the suit 1 towards the outside when the pressure of this air exceeds a determined value.

The suit 1 is also equipped with air distribution means 13 having a first and a second outlet branch 14, 15. These branches are housed in the suit 1. The second branch 15 is connected to an inlet of a filter 16 of HEPA 19 type (High Efficiency Particulate Air Filter or « High Efficiency Particulate Absorbing Filter), housed in the suit 1 and capable in one pass of filtering at least 99.97% of particles having a diameter equal to or more than 0.3 μm.

Figure 5:
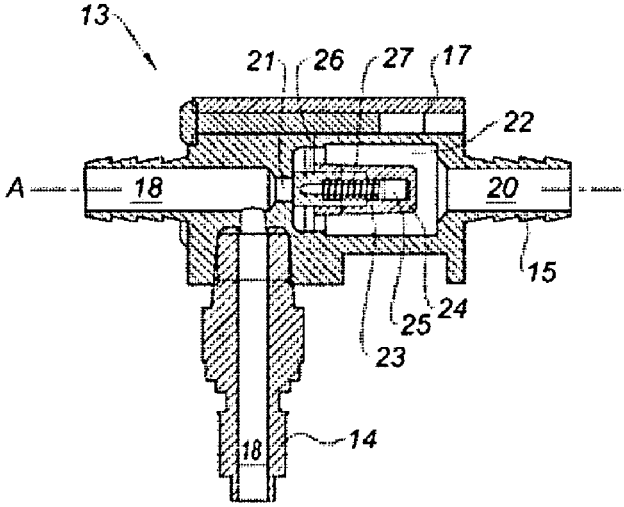
FIG. 5 is a longitudinal section view of the air distribution means.
Figure 6:
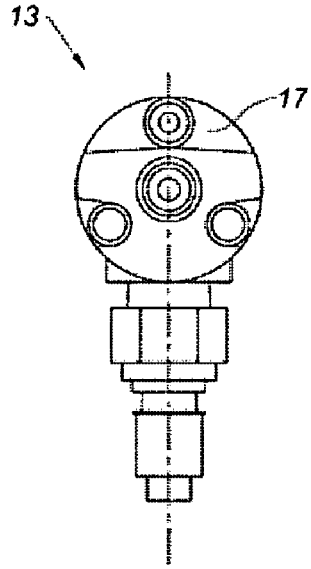
FIG. 6 is a side view.

The structure of the air distribution means 13 is more particularly illustrated in FIGS. 5 and 6. They comprise a body 17 in which there are arranged a first channel 18 forming the air intake, a second channel 19 connected to the first channel 18 extending perpendicular thereto, and formed in the first air outlet branch 14, and a third channel 20 formed in the second air outlet branch 15 and opening into the first channel 18 at a calibrated opening 21. The third channel 20 extends along axis A of the first channel 18 and has a chamber 22 of larger diameter into which the first channel 18 opens. A tubular support 23 is fixed inside the chamber, the support comprising a first end facing the side of the calibrated opening 21 and a second end 24 facing the free end of the third channel 20.

The second end 24 of the support 23 is tapped and cooperates with a screw 25 forming an abutment.

A shutter 26 is slidingly mounted within the tubular support 23, a counter-weighted return spring 27 also being mounted in the support 23, between the shutter 26 and the spring 25.

The return spring 27 and the shutter 26 are arranged such that the shutter 26 is applied against the calibrated opening 21 if there is no air pressure in the first channel 18, the shutter 26 being gradually moved away from the opening 21 when the air pressure inside the first channel 18 exceeds a predetermined value.

Figure 8:
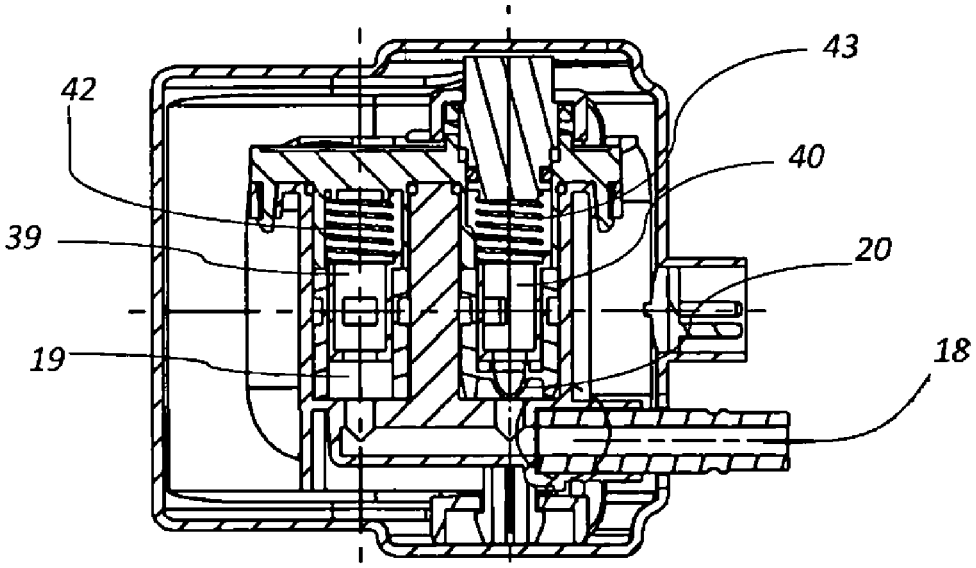
FIG. 8 illustrates a variant of the distributor in FIG. 5.

FIG. 8 illustrates a variant of embodiment of the air distributor in which the same parts are designated by the same reference numbers as previously. It is to be noted that in this figure the shutter 26 is not shown although it is used.

In this distributor, the channels 19, 20 connected to the two outlets for supplying air to the wearer and for ventilating the suit, are equipped with airflow regulators respectively formed of pistons 39 and 40 subjected on one side to air pressure and on the opposite side to the antagonist action of a counter-weighted spring 42, 43 to ensure a flow rate within a determined range in each outlet conduit.

For example, when the inlet pressure is between 3 and 8 bars, the overall outlet flow rate is between 500 and 800 liters per minute and the distribution, via adapted counter-weighting of the springs 42 and 43, is 170 to 260 liters per minute for breathable air and 330 to 540 liters per minute for the air to ventilate the suit.

The outlet of the filter 16 feeds several ventilation channels 28 formed in the suit 1. These direct the air derived from the filter 16 towards the heat-accumulating regions 29 such as those arranged in the vicinity of the wearer's armpits, knees and groin.

The first branch 14 is connected to a nozzle 30 providing air to the hood 31, via a HEPA filter 32 and an air supply line 33.

This line comprises one fork-shaped end having a first and a second branch 34, 35 each provided with a connector.

The hood 31 has a front visor 36 and a back part equipped with a release valve (not visible) arranged to allow release of the air contained in the hood 31 towards the outside when it exceeds a determined pressure value.

The inner volume of the hood 31 is delimited by a neckband 37 made in a flexible, elastic material having a central opening allowing insertion of the wearer's head.

The hood 31 further comprises a removable band (not illustrated) which, after removal, is able to release an opening for access to inside the hood 31.

The hood 31 is mounted on a sheet of fabric 37 for attachment to the wearer.

Figure 4:
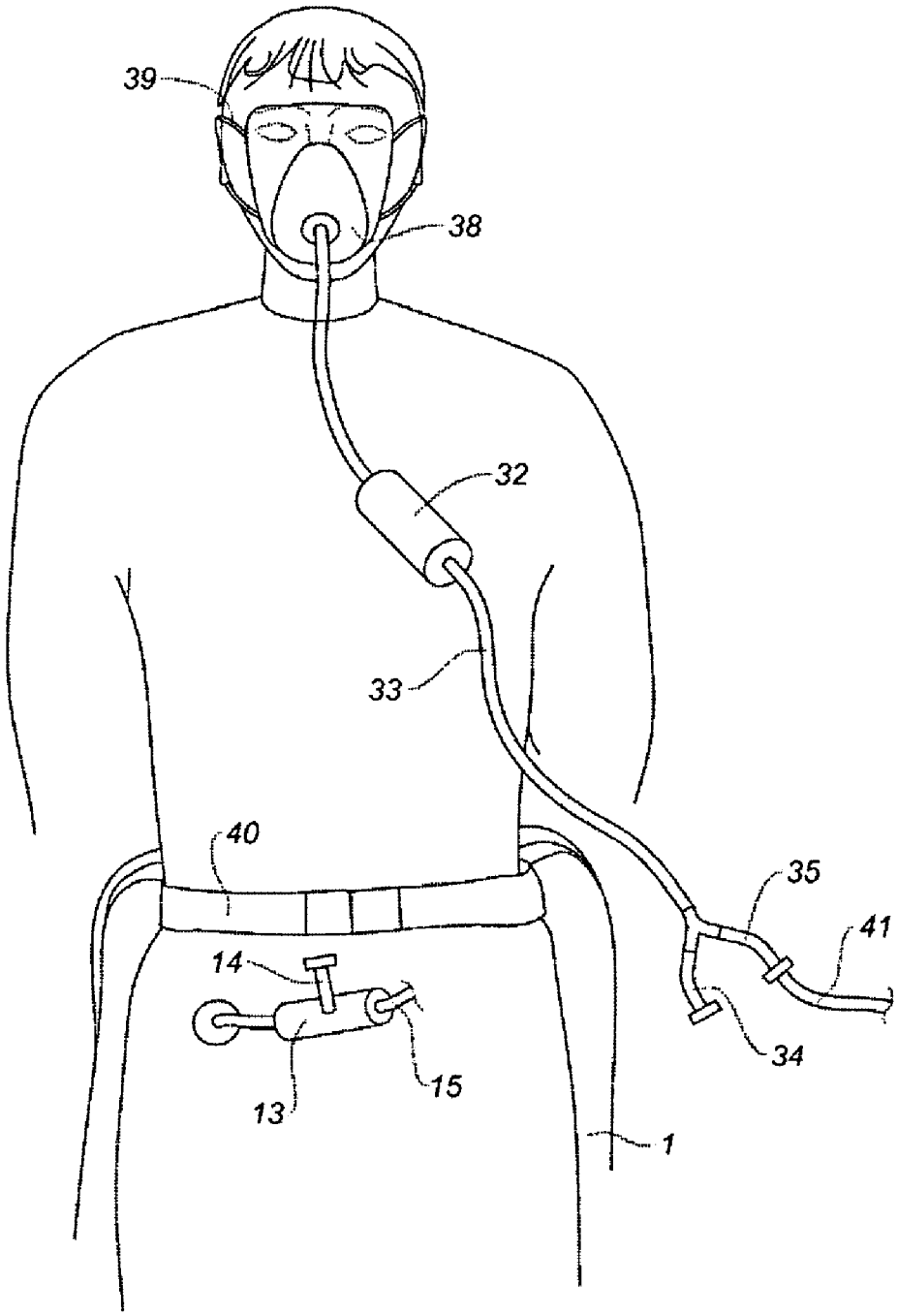
FIG. 4 is a view corresponding to FIG. 1, illustrating one variant of embodiment of the invention.

According to another embodiment, illustrated in FIG. 4, the supply line 33 is not connected to a hood 31 but to a mask 38 attached via holding straps 39.

Figure 2:
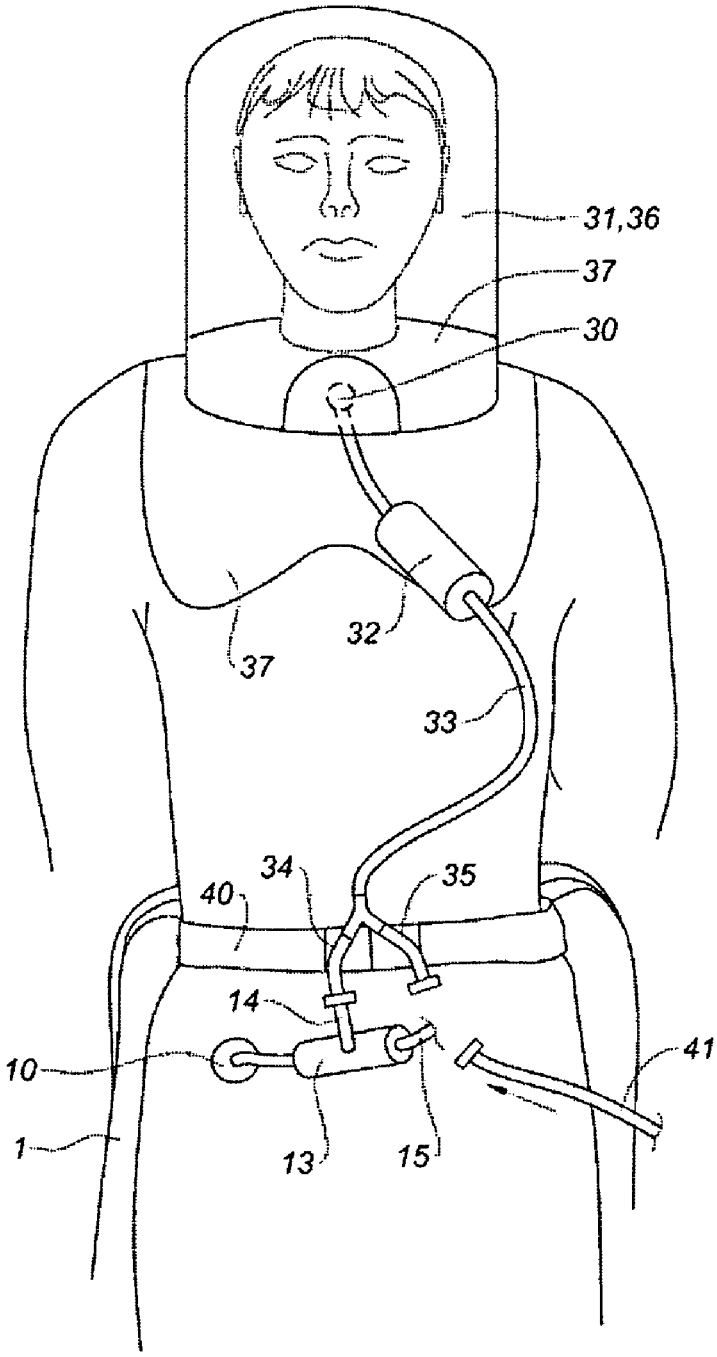
FIGS. 2 and 3 are views illustrating the successive steps for removing the protective ensemble.
Figure 3:
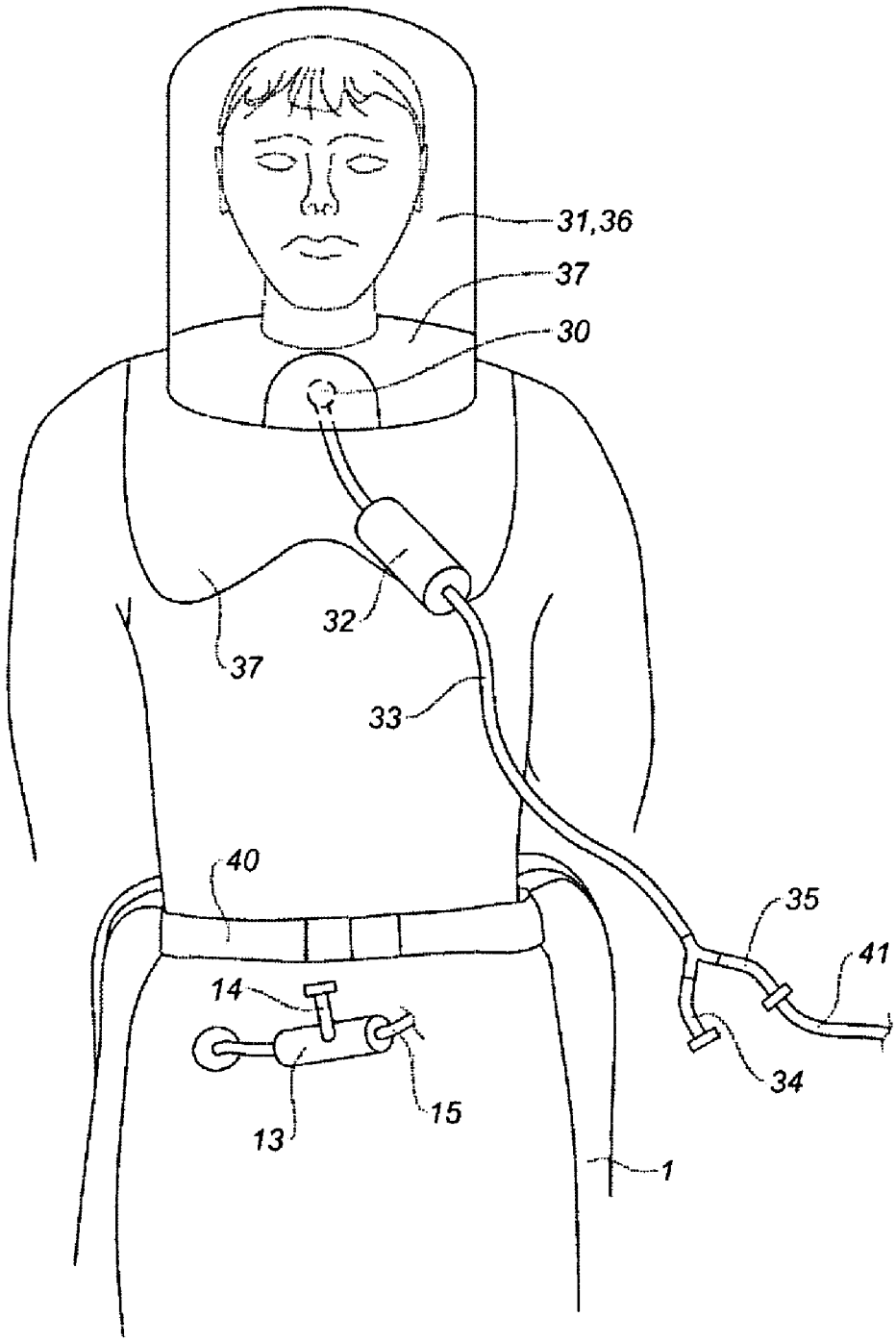

The functioning of the invention will now be described in more detail with reference to the embodiment illustrated in FIGS. 1 to 3.

When putting on the assembly, the user first dons the suit 1 which is fitted by means a belt 40 integrated in the suit 1, connects the supply line 33 to the connector 10 and connects the first branch 34 of the air supply line 33 to the first branch 14 of the distribution means 13. The hood 31 is thereby supplied with air via the compressed air network 11.

In parallel the shutter 26, subjected to the force exerted by the compressed air at the first channel 18, is moved within the tubular support 23 against the return force exerted by the spring 27, so that it moves away from the calibrated opening 21. The passing of air from the first channel 18 to the third channel 20 is then permitted, the ventilation ducts 28 thereby being supplied with air.

The user can then slip on the hood 31 and finish installing the remainder of the suit 1, in particular covering the hood 31 with the helmet 2 then closing the zip fastener 7. It is pointed out that the user is able to be equipped unassisted.

Once closed, the suit 1 is gradually inflated with air derived from the ventilation ducts 28, this air then being able to escape via the release valve 12 ad/or via leaks which may appear at the zip fastener 7 for example. Therefore, despite slight leaks the user does not run any risk since the air escaping from the suit 1 prevents any entry of particles.

The wearer can then proceed with carrying out the tasks to be conducted and is able to move unrestricted to within the extent authorised by the hose 11 of the compressed air supply network.

Once the operations are completed, the wearer leaves the contaminated area, possibly passes through a decontamination airlock, and then removes the removable band 9 to open the suit 1. This suit then rolls up outwardly to avoid any contact between the hands or the remainder of the body with the outer wall of the suit 1 on which radioactive particles may have deposited.

The wearer then connects the second branch 35 to a secondary supply network 41 of compressed air and disconnects the first branch 34 from the suit 1. The suit can then be fully removed, the hood 31 continuing to be supplied by the secondary supply network 41.

It is pointed out that the suit 1 is a disposable suit since in this embodiment no provision is made for possible repositioning of the removable band 9 after removal thereof.

In the event of a pressure drop in the air supply network 11, the air pressure in the first channel 18 is decreased. The force exerted by the counter-weighted spring 27 then tends to move the shutter 26 in the direction of the calibrated opening 21, the result of which is to reduce the cross-section of the air throughway from the first channel 18 to the third channel 20. The flow rate of the air feeding the ventilation ducts 28 is thereby reduced. The proportion of air dedicated to feeding the hood 31 is therefore increased.

Figure 7:
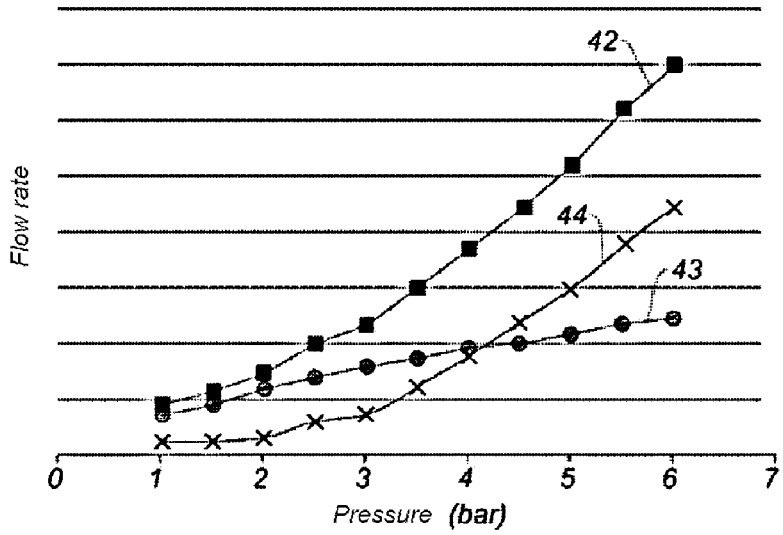
FIG. 7 is a diagram showing the flow of the air supply network, the flow of the ventilation means and the flow of the air feed means to the user, in relation to the pressure of the air supply network.

This principle is best illustrated in FIG. 7, using the air distribution means shown in FIG. 5, which gives a diagram in relation to the air pressure in the first channel 18 of a first curve 42 illustrating the air flow circulating in the first channel 18, a second curve 43 illustrating the air flow circulating in the second channel 19 and a third curve 44 illustrating the air flow circulating in the third channel 20.

The air flow circulating in the first channel 18 i.e. derived directly from the air supply network 11, reduces with pressure. In addition, in the event of a pressure drop in the air supply network 11 i.e. in the first channel 18, the flow dedicated to ventilation is highly limited by movement of the shutter 26 (see curve 44). As a result, the air flow dedicated to feeding air to the wearer is scarcely reduced (see curve 43).

It is therefore noted that in the event of a pressure drop in the air supply network, the invention allows priority to be given to the breathable air supply to the user, to the detriment of the user's comfort provided by ventilation of the suit.

The invention therefore provides a personal protective suit and ensemble that are reliable whilst remaining ergonomic, comfortable and easy to use.

The invention claimed is:

1. Personal protective suit comprising:

a sealed outer shell equipped with connection means intended to be connected to a pressurized air source, means for air distribution having an air intake connected to the connection means at least one first and one second air outlet, respectively intended to feed means for delivering breathable air to the wearer and means for ventilating the suit, wherein the air distribution means comprise a valve reacting to air pressure at the air intake to reduce a rate of air flow of the second air outlet towards the suit when the air pressure at the air intake is below a determined value, whilst maintaining a supply of breathable air to the wearer.

2. The suit according to claim 1, the valve is designed such that the air flow rate in the second air outlet decreases progressively with the air pressure at the air intake.

3. The suit according to either of claims 1, wherein the valve comprises a shutter which, cooperating with a return spring, is designed to shut off all or part of the second air outlet, in relation to the air pressure at the air intake.

4. The suit according to claim 3, wherein the air distribution means comprise a body in which there are arranged a first channel forming the air intake, a second channel connected to the first channel and forming the first air outlet, and a third channel forming the second air outlet and leading into the first channel at a calibrated opening, the shutter and the return spring being arranged such that the shutter is applied against the calibrated opening if there is no air pressure in the first channel, the shutter being progressively moved away from the opening when the air pressure in the first channel exceeds a predetermined value.

5. The suit according to claim 4, wherein the channels connected to the air outlets for the supplying of air to the wearer and for ventilating the suit are equipped with flow regulators.

6. The suit according to claim 5, wherein each flow regulator comprises a piston which, housed in a channel, is subjected to action of a spring, to modify the cross-section of the air passage in relation to the pressure.

7. A personal protective ensemble comprising means for delivering air to the wearer, equipped with an air supply line, comprising a protective suit according to claim 1, the air supply line being connected to the first air outlet of the distribution means.

8. The protective ensemble according to claim 6, wherein the air supply line comprises a first and a second air intake, the first air intake being connected to the first air outlet of the distribution means in position of normal use, the second air intake of the supply line being intended to be connected to a secondary source of compressed air.

9. The protective ensemble according to claim 7, wherein the means for delivering air to the wearer comprise a mask or a hood delimiting an inner volume fed with air.

10. The protective ensemble according to claim 7, wherein the suit comprises a release valve arranged to allow release of the air contained inside the suit when the pressure of this air exceeds a determined pressure value.

11. The protective ensemble according to claim 7, wherein the suit comprises a removable band which, after removal, is capable of releasing an opening intended to facilitate stepping out of the suit.

12. The protective ensemble according to claim 7, wherein the suit is equipped with at least one ventilation duct connected to the second outlet of the distribution means, and designed to direct part of the pressurized air into the inner volume of the suit.

* * * * *